US006943738B1

(12) United States Patent
Mattsson et al.

(10) Patent No.: US 6,943,738 B1
(45) Date of Patent: Sep. 13, 2005

(54) COMPACT MULTIBAND INVERTED-F ANTENNA

(75) Inventors: Jan-Ove U. Mattsson, Plantation, FL (US); Adam R. Aron, Fort Lauderdale, FL (US); Lorenzo A. Ponce De Leon, Lake Worth, FL (US); Michael J. Slipy, Oakland Park, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/847,734

(22) Filed: May 18, 2004

(51) Int. Cl.[7] ..... H01Q 1/24

(52) U.S. Cl. ..... 343/700 MS; 455/550.1

(58) Field of Search ..... 343/700 MS

(56) References Cited

U.S. PATENT DOCUMENTS

| | | | | |
|---|---|---|---|---|
| 6,670,923 | B1 | 12/2003 | Kadambi et al. | |
| 2002/0126047 | A1 * | 9/2002 | Laureanti | 343/700 MS |
| 2004/0196190 | A1 * | 10/2004 | Mendolia et al. | 343/700 MS |

FOREIGN PATENT DOCUMENTS

| | | |
|---|---|---|
| WO | WO2004/010528 | 1/2004 |

OTHER PUBLICATIONS

K. Fujimoto et al., *Small Antennas,* Research Studies Press, Ltd. Somerset, England. 1987, pp. 116-119.

* cited by examiner

*Primary Examiner*—Douglas A. Wille

(57) ABSTRACT

A compact multiband Inverted-F antenna (110) that has a compact form factor and is particularly suited for manufacturability and inclusion into small form-factor devices. The Inverted-F Antenna (110) includes a first arm (150) and a substantially parallel second arm (152) connected by a conductive bridge (206). An RF feed that has an RF contact (126) and a ground contact (124) is attached to a middle portion of the second arm (150). The Inverted-F antenna (110) is suitable for mounting on an external face of a non-conductive support (112). The RF feed (150, 152) extends through the non-conductive support to facilitate electrical connection to RF circuits (108). The Inverted-F Antenna (110) has a three band RF characteristic (300), with the upper two bands chosen to form a single, continuous RF band (304).

16 Claims, 2 Drawing Sheets

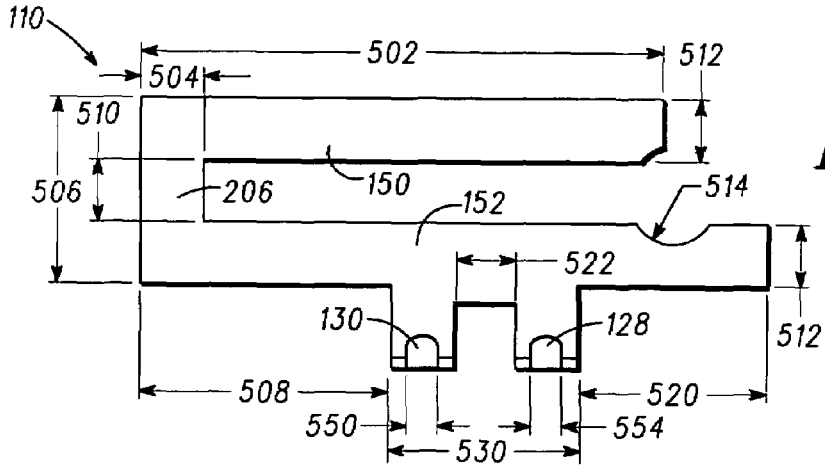
500
FIG. 5
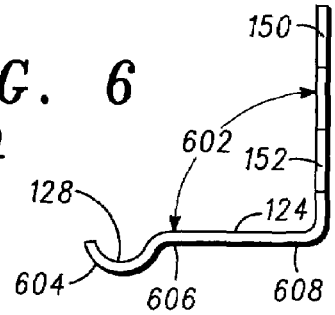
FIG. 6
600
FIG. 7
700
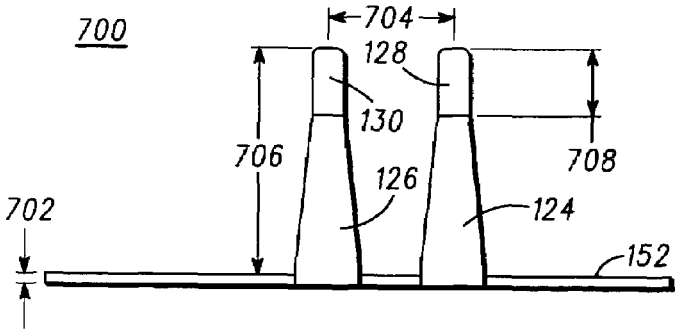
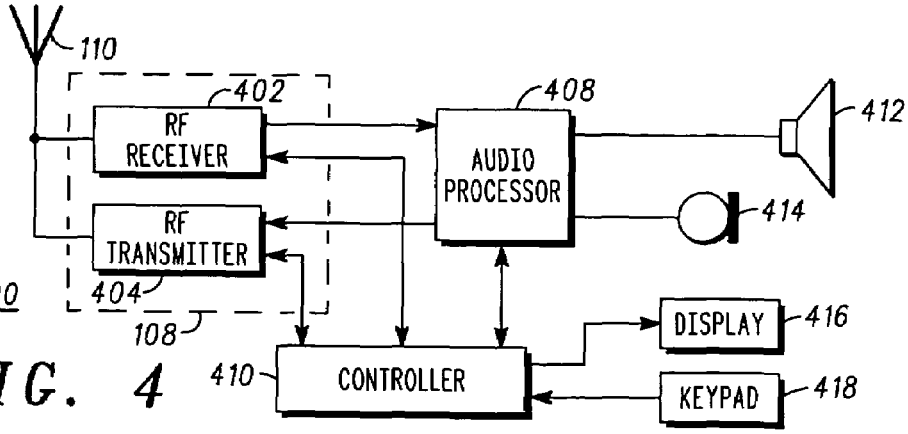
FIG. 4

COMPACT MULTIBAND INVERTED-F ANTENNA

FIELD OF THE INVENTION

The present invention generally relates to the field of radio frequency antennas and more particularly to compact, multiple band antennas.

BACKGROUND OF THE INVENTION

Radio communication devices are increasingly being used to communicate in multiple RF bands. An example of a multiple band RF device is a device that is able to communicate by using either the 802.11(b) or the 802.11(a) standard. The 802.11(b) standard uses RF signals in the region near 2.4 GHz and the 802.11(a) standard uses RF signals that cover a broader frequency range in the region near 5.0 GHz. It is often desirable, especially in small and/or portable devices, to minimize the number of antennas that are used on the device, and using a single antenna to cover multiple bands generally provides savings in size and manufacturing cost. Antennas for portable electronics are typically mounted inside the devices' housing in order to physically protect the antenna structure.

RF antennas are generally required to be located physically near the RF circuits to which they connect. This physical location requirement, manufacturability considerations, and the fragility of many internal antenna structures, result in design decisions to mount antenna structures on the electronic devices' printed circuit boards. However, mounting the antenna on the circuit board occupies printed circuit board area and limits the size of the antenna structure in an effort to minimize printed circuit board size.

Therefore a need exists to overcome the problems with the prior art as discussed above.

SUMMARY OF THE INVENTION

According to an embodiment of the present invention, as shown in FIG. 1, an Inverted-F antenna has a first arm with a first end and a second arm that is substantially parallel to, co-planar with, and separated from the first arm along a length of the first arm and the second arm. The second arm has a first end that is substantially aligned with the first end of the first arm. The Inverted-F antenna also has a conducting bridge that is electrically connected to the first end of the first arm and the first end of the second arm. The Inverted-F antenna also has a feed element that is electrically connected to a middle point of the second arm. The feed element is used to connect the Inverted-F antenna to an RF feed on a circuit board. The first arm, the second arm and the conducting bridge of the Inverted-F antenna are removed from the circuit board and at least one of the first arm, the second arm and the conducting bridge are formed so as to be secured to a support that is separate from the circuit board.

According to an embodiment, an antenna and a device utilize the significant advantages of the present invention.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 4 is a schematic diagram for a cellular phone incorporating an Inverted-F Antenna, according to a second alternative embodiment of the present invention.

FIG. 5 illustrates an Inverted-F antenna front dimensional view, according to an exemplary embodiment of the present invention.

FIG. 6 is a side view angular measurement drawing for an Inverted-F antenna, according to an exemplary embodiment of the present invention.

FIG. 7 illustrates an Inverted-F antenna bottom-up dimensional view of the Inverted-F antenna, according to an exemplary embodiment of the present invention.

DETAILED DESCRIPTION

As required, detailed embodiments of the present invention are disclosed herein; however, it is to be understood that the disclosed embodiments are merely exemplary of the invention, which can be embodied in various forms as illustrated in the non-limiting exemplary embodiments of FIGS. 3, 4, 5, 6 and 7. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Figure 1:
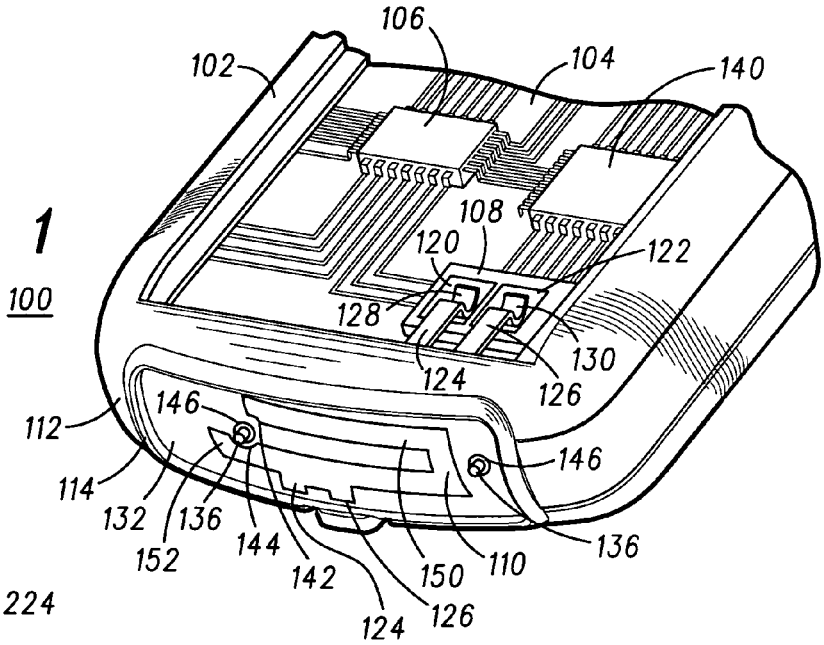
FIG. 1 is an isometric view of a cellular phone incorporating an Inverted-F antenna, according to an embodiment of the present invention.

FIG. 1 illustrates a top-back isometric view of a cellular phone 100 with its back cover removed, according to an exemplary embodiment of the present invention. The top-back view 100 illustrates an exemplary cellular phone 102, Inverted-F Antenna 110, and internal circuits of the cellular phone 100, as will be discussed in more detail below. The exemplary cellular phone 102 has a case 112 that is constructed of molded, non-conductive plastic in the exemplary embodiment. The exemplary cellular phone 102 further includes a printed circuit board 104. The printed circuit board 104 in the exemplary embodiment supports an RF circuit module 108 and controller circuits 106 and audio processing circuits 140. The RF circuit module 108 of the exemplary embodiment has an RF contact 122 and a ground contact 120 that provide an RF connection interface used to couple RF signals between the RF circuit module 108 and the Inverted-F Antenna 110. According to alternative embodiments of the present invention, the Inverted-F Antenna 110 may be used for reception of RF signals that are coupled from the Inverted-F Antenna 110 to the RF circuit module 108, or for transmission of RF signals that are coupled from the RF circuit module 108 to the Inverted-F Antenna 110, or both.

The exemplary cellular phone 102 includes an Inverted-F Antenna 110 that supports communications in multiple RF bands, as is described below. This exemplary Inverted-F Antenna 110 is constructed out of a thin beryllium-copper sheet metal that forms the antenna elements, as is described below, and includes spring contacts 128,130, that connect the feed structure to RF electronics 108 in the cellular phone 102. The spring contacts 128,130, in the exemplary embodiment are gold plated to improve the conductive properties of connections between the spring contacts and the RF circuits 108. The Inverted-F antenna 110 of the exemplary embodiment is mounted on an exterior face of the case 112. This exterior face is an outside portion of case 112 that is a place for mounting the Inverted-F antenna 110 at a location that is removed from the printed circuit board 104 and also removed from the other electronics of the cellular phone 102. Case 112 of the exemplary embodiment is a non-conductive support for the elements of the Inverted-F antenna 110.

The Inverted-F antenna 110 is encased in a plastic overmold 132 during its fabrication to improve the ruggedness of the Inverted-F antenna assembly prior to mounting on the cellular phone 102. The overmold 132 of the exemplary embodiment is constructed of Lexan. The Inverted-F antenna 110 is constructed so as to be thin enough with the plastic overmold 132 to fit into a pocket 114 that is formed on the exterior face of the case 112. Plastic overmold 132 is formed to include openings 146 to accept pins 136 that are part of the case 112. The antenna structure 110 of the exemplary embodiment is attached to the housing by heat staking the two mounting pins 136 to form a retaining cap over openings 146 of the overmold 132. The conductive elements of the Inverted-F antenna 112 have a top cut-out 142 and a bottom cut out 144 to also accommodate mounting pins 136. Further embodiments use an adhesive material to hold the antenna assembly in place. Yet further embodiments use both heat staking and adhesives to secure the antenna assembly in place.

The Inverted-F antenna 110 of the exemplary embodiment includes a first arm 150 and a second arm 152. The Inverted-F Antenna 110 further has a feed element that includes an RF contact 124 and a ground contact 126, which are described in detail below. The feed element, including RF contact 124 and ground contact 126, forms a plane that is substantially perpendicular to a plane formed by the first arm 150 and the second arm 152. The ends of these contacts included in the feed element have spring contacts that facilitate electrical connection to RF circuits 108. The RF contact 124 has an RF spring contact 128 that is urged into physical and electrical contact with RF contact 120 when the printed circuit board 104 is positioned inside case 112 in the exemplary embodiment. Ground contact 126 is also urged into physical and electrical contact with the ground contact 122 by an RF spring contact 130. The feed element, including RF contact 124 and ground contact 126, is connected to a middle point of the second arm 152. A middle point of the second arm 152, as used in this specification, includes any point between the end points of the second arm 152. The feed element of the exemplary embodiment, including the RF contact 124 and the ground contact 126, extends into the inside of case 112 to allow connection to the RF circuits 108. The inside of case 112 is a side of the case that is substantially opposite the exterior face of the non-conductive case 112.

Figure 2:
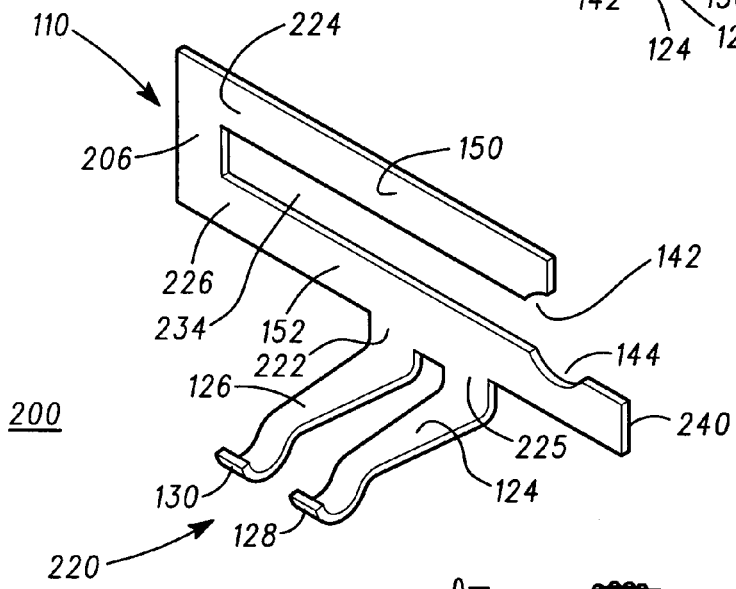
FIG. 2 is a view of an Inverted-F antenna, according to an embodiment of the present invention.

FIG. 2 is a compact Inverted-F Antenna isometric view 200 according to an exemplary embodiment of the present invention. The compact Inverted-F Antenna 110 of the exemplary embodiment has a first arm 150. The first arm 150 of the exemplary embodiment has a first end 224. The compact Inverted-F Antenna 110 of the exemplary embodiment further has a second arm 152 that has a first end 226 that is substantially aligned with the first end 224 of the first arm 150. The first end 226 of the first arm 150 is electrically connected to the first end 226 of the second arm 152 by the conducting bridge 206. The second arm 152 of this exemplary embodiment is substantially parallel to, co-planar with and separated from the first arm 150 and separated from the first arm 150 along a length of the first arm 150. In this exemplary embodiment, these two arms are substantially parallel with each other along the entire length of the first arm 150, which is the shorter arm. The conducting bridge 206 of the exemplary embodiment is also co-planar with a plane formed by the first arm 150 and the second arm 152.

The compact Inverted-F Antenna 110 further has an RF contact 124 that is used to connect the Inverted-F antenna 110 to an RF feed on circuit board 104. The RF contact 124 has a first end 225 that is electrically connected to and that physically depends from a middle point of the second arm 152. The compact Inverted-F Antenna 110 further has a ground connection element 126. The ground connection element 126 has a first end 222 that is also electrically connected to and that physically depends from the middle point of the second arm 152 at a point that is separate from the connection point of the first end 225 of the RF contact 124. The RF contact 124 and the ground connection element 126 are separated by a feed gap 220 in the exemplary embodiment.

The dimensions of the RF contact 124 and the ground connection element 126 are selected so as to provide an impedance match to the RF output of the circuit module 108. The dimensions of the RF contact 124 and the ground connection element 126 affect the reactive characteristics of those elements at various frequencies. For example, the ground connection element provides grounding for the Inverted-F Antenna 110 and forms a shunt inductance that is used to adjust the impedance of the antenna to match the antenna's RF feeding structure.

The RF contact 124 and the ground connection element 126. each have spring contacts 128, 130 to facilitate electrical connection to the RF circuit module 108. The RF contact 124 has an RF connection spring contact 128 and the ground connection element 126 has a ground spring contact 130. The entire Inverted-F Antenna structure 110 of the exemplary embodiment is formed from a thin, conductive metal that allows formation of spring contacts on the end of the RF contact 124 and the ground connection element 126. The spring contacts 128, 130 on the exemplary embodiment are located on ends of the RF contact 124 and ground connection element 126 that are opposite the end that attaches to the second arm 152.

The Inverted-F Antenna 110 of the exemplary embodiment has a triple band characteristic. The dimensions of the elements of the Inverted-F Antenna 110 are able to be selected so as to cause resonance, and thereby efficient RF radiation and reception characteristics, in three RF bands. The dimensions of the exemplary Inverted-F Antenna 110 are chosen so that the two higher band resonances of this antenna structure are combined so as to form what appears to behave as a larger, single, continuous RF band. This single, continuous band is chosen to include, for example, the full RF band that is assigned to the IEEE 802.11a Wireless LAN band. In this exemplary embodiment, the lower resonance band is selected to include, for example, the RF band that is assigned to the 802.11b Wireless LAN band. These two bands are in the vicinity of 5.0 GHz and 2.4 GHz, respectively.

The conducting bridge 206 connects the first arm 150 to the second arm 152 so as to form a U-shaped structure. As discussed above, the RF contact 124 and ground connection element 126 connect to a middle point of the second arm 152. The first end 222 of the ground connection element 126 is also a connection point on the second arm 152. This first end/connection point 222 forms resonating quarter-wavelength structures between that point and the ends of the U-shaped structure formed by the connecting bridge 206, the first arm 150 and the second arm 152. A shortest resonant wavelength, which corresponds to a second resonance frequency that is at the upper end of the IEEE 802.11a RF band, is formed by the conductive path between the first end/connection point 222 and the second end 240 of the second arm 152. A longest resonating wavelength, which corresponds to the frequency of the IEEE 802.11B RF band, is formed by the conductive path between the first end/connection point 222 and the second end 142 of the first arm 150, as is formed by the first arm 150, the conducting bridge 206 and part of the second arm 152. The U-shape structure of the first arm 150, second arm 152 and the conducting bridge 206 forms the slot 234 that influences a third resonance frequency. This third resonance frequency is selected in the exemplary embodiment to be adjacent to and slightly lower in frequency than the second, or highest, resonance frequency so as to synthesize a larger single RF band. The second and adjacent third resonance frequency bands are combined together in the exemplary embodiment by a careful adjustment of the dimensions, including both the width and length, of the first arm 150, the second arm 152, the width of the formed slot 234, and the dimensions of the RF connection element 124 and the ground connection element 126, so as to form the efficient radiation and reception characteristics in the two bands of interest.

Figure 3:
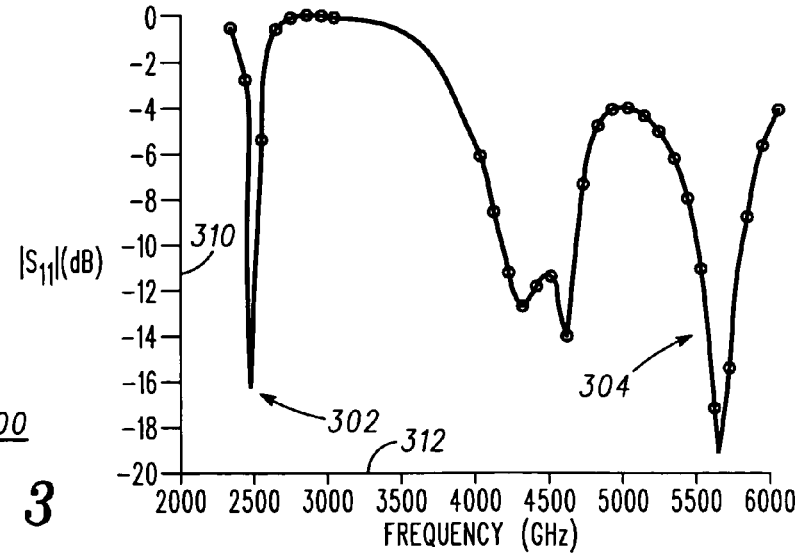
FIG. 3 illustrates an Inverted-F Antenna RF input return loss ($S_{11}$) graph, according to a first alternative embodiment of the present invention.

FIG. 3 illustrates an $S_{11}$ parameter chart 300 that was derived by computer simulation for the operational frequency bands of the exemplary Inverted-F Antenna 110 shown in FIG. 2. The $S_{11}$ parameter chart 300 illustrates the RF energy that is reflected from an input of the Inverted-F Antenna 110. Energy that is not reflected is assumed to be totally coupled by the antenna, i.e., radiated (or received or both), so that lower values shown on the $S_{11}$ parameter chart 300 indicate better radiation and reception performance. The $S_{11}$ parameter chart 300 indicates efficient radiation and reception in the IEEE 802.11a band 304, i.e., the RF band in the vicinity of 5.0 GHz. The $S_{11}$ parameter chart 300 also indicates efficient radiation and reception in the IEEE 802.11b band 302, i.e., the RF band in the vicinity of 2.4 GHz.

FIG. 4 illustrates an exemplary cell phone body electronic schematic diagram 400. This exemplary schematic diagram 400 illustrates the Inverted-F Antenna 110 being connected to the RF module 108, which includes an RF receiver 402 and an RF transmitter 404. The RF receiver 402 receives RF signals from the Inverted-F Antenna 110 and produces detected audio and/or data output. Detected signals are provided to, for example, audio processor 408 for required processing and preparation and conditioning for output to acoustic speaker 414. The detected data signals, for example, may be coupled to the controller 410.

The exemplary cell phone body electronic schematic diagram 400 also includes an RF transmitter 404 that is used to produce and modulate an RF signal for transmission. The RF transmitter 404 transmits, for example, voice signals produced by audio processor 408 based upon audio signals that are picked up and electrically produced by the microphone 412. Additionally, the controller 410 may produce data signals that are coupled to the RF transmitter 404 that then transmits the data signals via the Inverted-F Antenna 110. The RF transmitter 404 and the RF receiver 402, in this example, share a common RF antenna, the Inverted-F Antenna 110. The common Inverted-F Antenna 110 may be shared through RF sharing and/or switching means (not shown), in a manner well known to those of ordinary skill in the art, to allow both transmit and receive wireless communications over one or more communication channels.

Controller 410 of the exemplary embodiment includes a programmable processor (and/or controller) that normally includes a computer readable medium that contains programming instructions required to control the cellular phone 102. The control circuits 410 also receive input from the keypad 418 and from other user interface input devices, as is well known to those of ordinary skill in the art. Controller 410 further provides user output through a display 416 and via other user interface output devices and/or via a computer data interface, as are well known to those of ordinary skill in the art.

FIG. 5 illustrates an Inverted-F antenna front dimensional view 500 according to an exemplary embodiment of the present invention. The Inverted-F antenna 110 of the exemplary embodiment has a first arm length 502 of 13.72 mm. The connecting bridge width 504 is 2 mm. The connecting bridge height 506 is 4.55 mm. A second arm left length 508 is 7 mm and a second arm right length 520 is 4.7 mm. The RF feed width 530 is 4.4 mm, the RF contact width 550 and the ground contact width 554 are 0.9 mm. The RF contact to ground contact gap width 522 is 1.2 mm. The pin cut out diameter 514 is 2.3 mm.

FIG. 6 is a side view angular measurement drawing 600 for an Inverted-F antenna 110 according to an exemplary embodiment of the present invention. The antenna to RF feed angle 602 is 91.0°±2.0°. The ground spring contact 128, which has the same dimension as the RF spring contact 130, has a spring contact radius of 0.78 mm, a spring transition radius 606 of 0.4 mm and a antenna to RF feed radius of 0.58 mm.

FIG. 7 illustrates an Inverted-F antenna bottom-up dimensional view 700 of the Inverted-F antenna 110 according to an exemplary embodiment of the present invention. The element thickness 702 is 0.18 mm. The contact center separation distance 704 is 2.8 mm and the contact length 706 is 5.73 mm. The spring contact plating length 708 is 1.84 mm. The spring contacts are plated with gold to improve the electrical conductivity of the contact formed by the spring contacts, as is known by ordinary practitioners in the relevant arts.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. An antenna, comprising:

a first arm with a first end;

a second arm, substantially parallel to, co-planar with, and separated from the first arm along a length of the first arm and the second arm, and with a first end that is substantially aligned with the first end of the first arm;

a conducting bridge, electrically connected to the first end of the first arm and the first end of the second arm; and a feed element, electrically connected to a middle point of the second arm, for connection to an RF feed on a circuit board, wherein the first arm, the second arm and the conducting bridge are mechanically unsupported by the circuit board while being designed for RF signal coupling with circuits on the circuit board, and wherein at least one of the first arm, the second arm, and the conducting bridge, are formed so as to be supported by a supporting structure that is mechanically separate from the support of the circuit board.

2. The antenna according to claim 1, wherein the at least one of the first arm, the second arm and the conducting bridge are at least partially contained within an overmold.

3. The antenna according to claim 1, wherein the conducting bridge comprises a conductive sheet forming a plane that is substantially co-planar with a plane formed by the first arm and the second arm.

4. The antenna according to claim 1, wherein the antenna radiates and receives RF energy in three RF bands, and wherein two of the three RF bands are adjacent so as to synthesize a larger, single RF band.

5. The antenna according to claim 4, wherein the three RF bands comprise a first RF band comprising 2.4 GHz and the larger, single RF band comprises 5.0 GHz.

6. The antenna according to claim 1, wherein the feed element comprises spring contacts for electrical and mechanical contact to the RF feed.

7. The antenna according to claim 6, wherein the spring contacts are located on an end of the feed element that is opposite the second arm.

8. The antenna according to claim 1, wherein the feed element comprises:

a ground contact; and an RF contact separated from the ground contact by a gap, wherein the RF contact and the ground contact form a plane that is substantially perpendicular to a plane formed by the first arm and the second arm.

9. The antenna according to claim 8, wherein the feed element comprises spring contacts for electrical and mechanical contact to the RF feed.

10. The antenna according to claim 9, wherein the RF contact has an RF spring contact and the ground contact has a ground spring contact, wherein the RF spring contact and the ground spring contact are located on an end of the feed element that is opposite the second arm.

11. An RF component, comprising:

a first arm with a first end;

a second arm, substantially parallel to, co-planar with, and separated from the first arm along a length of the first arm and the second arm, and with a first end that is substantially aligned with the first end of the first arm;

a conducting bridge, electrically connected to the first end of the first arm and the first end of the second arm;

a non-conductive support, mechanically connected to at least one of the first arm, the second arm and the conducting bridge; and a feed element, electrically connected to a middle point of the second arm, for connection to an RF feed on a circuit board, wherein the first arm, the second arm and the conducting bridge are mechanically unsupported by the circuit board while being designed for RF signal coupling with the RF feed on the circuit board, and wherein at least one of the first arm, the second arm, and the conducting bridge, are formed so as to be supported by a supporting structure that is mechanically separate from the support of the circuit board.

12. The RF component according to claim 11, wherein the non-conductive support comprises plastic and at least one of the first arm, the second arm and the conducting bridge are secured to the non-conductive support by heat staking.

13. The antenna according to claim 11, wherein the at least one of the first arm, the second arm and the conducting bridge are at least partially contained within an overmold.

14. The RF component according to claim 11, wherein the non-conductive support forms an exterior face and wherein the at least one of the first arm, the second arm and the conducting bridge are located on the exterior face.

15. The RF component according to claim 14, wherein at least a portion of the RF feed extends to a side of the non-conductive support that is opposite the exterior face.

16. A wireless device, comprising:

a circuit board comprising at least one of an RF transmission circuit, an RF receiving circuit, audio processing circuits and controller circuits; and an inverted-F antenna, comprising:

a first arm with a first end;

a second arm, substantially parallel to, co-planar with, and separated from the first arm along a length of the first arm and the second arm, and with a first end that is substantially aligned with the first end of the first arm;

a conducting bridge, electrically connected to the first end of the first arm and the first end of the second arm; and a feed element, electrically connected to a middle point of the second arm, for connection to an RF feed on a circuit board, wherein the first arm, the second arm and the conducting bridge are mechanically unsupported by the circuit board while being designed for RF signal coupling with circuits on the circuit board, and wherein at least one of the first arm, the second arm, and the conducting bridge, are formed so as to be supported by a supporting structure that is mechanically separate from the support of the circuit board.

* * * * *